US007357268B2

(12) United States Patent
Yang

(10) Patent No.: US 7,357,268 B2
(45) Date of Patent: Apr. 15, 2008

(54) STORAGE RACK

(75) Inventor: Qinghao Yang, Shanghai (CN)

(73) Assignee: Global Industries Holdings Ltd., Nassau (BS)

( * ) Notice: Subject to any disclaimer, the term of this patent is extended or adjusted under 35 U.S.C. 154(b) by 791 days.

(21) Appl. No.: 10/844,212

(22) Filed: May 13, 2004

(65) Prior Publication Data

US 2005/0121446 A1 Jun. 9, 2005

(30) Foreign Application Priority Data

Dec. 5, 2003 (TW) ..... 92221495 U

(51) Int. Cl.
*B65D 1/24* (2006.01)
*B65D 25/30* (2006.01)
*B65D 1/36* (2006.01)

(52) U.S. Cl. ..... 220/4.26; 220/475; 220/23.88; 220/23.89; 220/520; 220/528

(58) Field of Classification Search ..... 220/4.26, 220/4.27, 4.22, 4.23, 475, 478, 23.88, 23.89, 220/528, 527, 520, 23.87
See application file for complete search history.

(56) References Cited

U.S. PATENT DOCUMENTS

| | | | | |
|---|---|---|---|---|
| 2,663,608 | A * | 12/1953 | Schauer | 312/326 |
| 3,606,005 | A * | 9/1971 | Meksula | 312/328 |
| 4,239,308 | A * | 12/1980 | Bradley | 312/201 |
| 6,634,728 | B1 * | 10/2003 | Leguin | 312/348.3 |
| 6,648,390 | B1 * | 11/2003 | Yang | 294/161 |
| 6,772,896 | B1 * | 8/2004 | Dobbin | 220/4.27 |
| 7,246,704 | B2 * | 7/2007 | Brunson et al. | 206/372 |
| 2004/0069668 | A1 * | 4/2004 | Finnigan | 206/372 |

* cited by examiner

*Primary Examiner*—Anthony D. Stashick
*Assistant Examiner*—Niki M. Eloshway
(74) *Attorney, Agent, or Firm*—Levenfeld Pearlstein, LLC

(57) ABSTRACT

A storage rack includes a pivot shaft, a plurality of plastic trays pivoted to the pivot shaft, each tray having a plurality of upwardly protruded locating blocks, and flat accessories boxes of different sizes selectively and detachably carried in the trays, each flat accessories box having a plurality of recessed bottom locating holes connectable to the locating blocks at the tray.

5 Claims, 7 Drawing Sheets

STORAGE RACK

BACKGROUND OF THE INVENTION

1. Field of the Invention

The present invention relates to storage racks and, more particularly, to such a storage rack, which comprises a plurality of trays pivoted to a pivot shaft, and a plurality of flat accessories boxes selectively and detachably fastened to the trays for keeping accessories.

2. Description of the Related Art

Various storage boxes are known for keeping accessories and small items. These storage boxes commonly comprise a box body defining a plurality of compartments for keeping different accessories, and a cover hinged to the box body. Several storage boxes may be joined, forming a storage rack.

There is known a loose-leaf type storage rack, which comprises a pivot shaft, a plurality of trays, and a plurality of flat accessories boxes mounted in the trays. The trays each have a plurality of knuckles respectively pivotally coupled to the pivot shaft such that the trays are arranged in a stack and can be turned about the pivot shaft together or respectively relative to one another. Positioning structure (not shown) is provided between the pivot shaft and the knuckles such that the trays can be respectively positioned in the desired angular position after having been turned about the pivot shaft. This design of loose-leaf type storage rack is functional. However, because the flat accessories boxes are available in only one single size, the user cannot arrange different sizes of flat accessories boxes in the trays to provide different combinations.

SUMMARY OF THE INVENTION

The present invention has been accomplished under the circumstances in view. It is the main object of the present invention to provide a storage rack, which enables the user to arrange the accessories boxes in the trays subject to provide different combinations. To achieve this and other objects of the present invention, the storage rack comprises a pivot shaft, a plurality of trays molded from plastics and respectively pivoted to the pivot shaft, a plurality of flat accessories boxes molded from plastics and respectively detachably carried in the trays, and a positioning structure adapted to secure the flat accessories boxes to the trays, wherein the positioning structure comprises a plurality of recessed locating holes disposed at a bottom side of each of the flat accessories boxes, and a plurality of locating blocks provided at a top side of each of the trays and adapted to engage the recessed locating holes.

DETAILED DESCRIPTION OF THE PREFERRED EMBODIMENT

Figure 1:
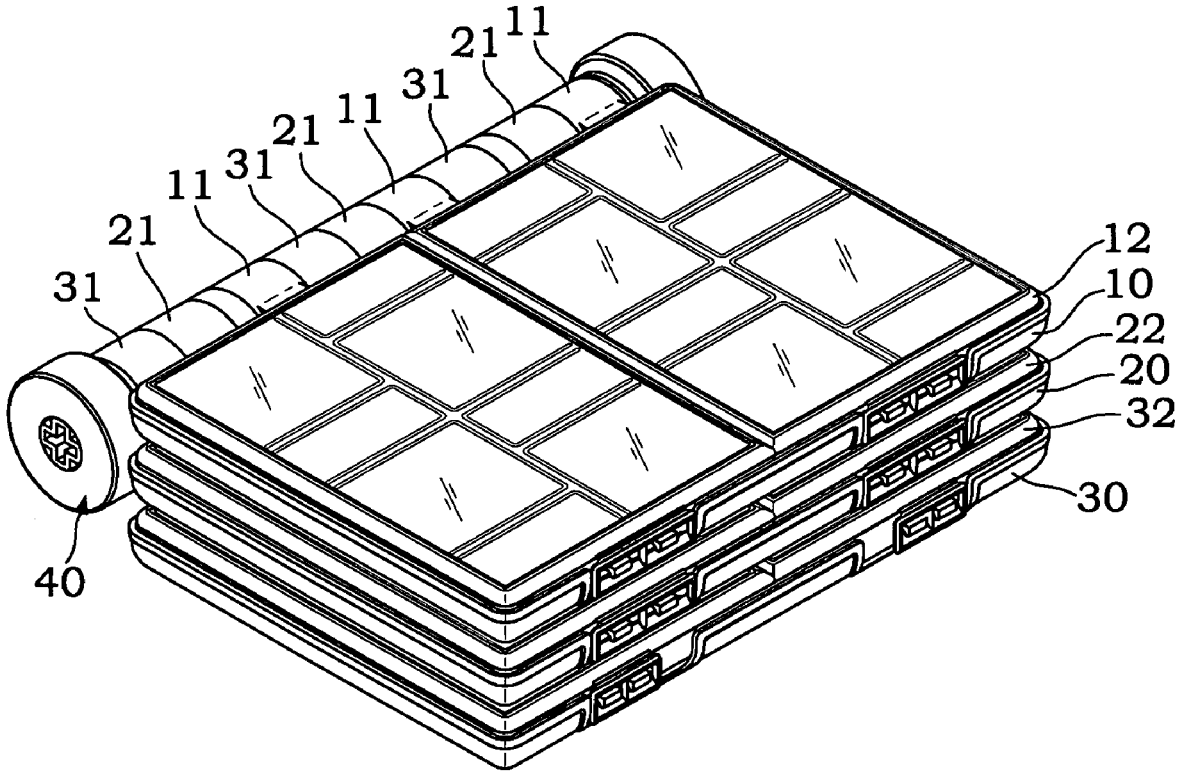
FIG. 1 is an elevational view of a storage rack according to the present invention.

Referring to FIG. 1, a storage rack is shown comprising a pivot shaft 40, a plurality of trays 10;20;30, and a plurality of flat accessories boxes 12;22;32 mounted in the trays 10;20;30. The trays 10;20;30 each have a plurality of knuckles 11;21;31 respectively pivotally coupled to the pivot shaft 40 such that the trays 10;20;30 are arranged in a stack and can be turned about the pivot shaft 40 together or respectively relative to one another. Positioning structure (not shown) is provided between the pivot shaft 40 and the knuckles 11;21;31 such that the trays 10;20;30 can be respectively positioned in the desired angular position after having been turned about the pivot shaft 40. The flat accessories boxes 12;22;32 have different sizes, i.e., a tray 10;20;30 can carry one big-size flat accessories box 12 (see FIG. 2), two medium-size flat accessories boxes 22 (see FIG. 7), or four small-size flat accessories boxes 32 (see FIG. 8).

Referring to FIGS. 2~6, each tray 10;20;30 has at least two locating blocks 50 upwardly disposed at the top and arranged at right angles; each flat accessories box 12;22;32 has a plurality of recessed bottom locating holes 51 corresponding to the locating blocks 50 at the tray 10;20;30. Because the trays 10;20;30 and the flat accessories boxes 12;22;32 are molded from plastics, the locating blocks 50 are springy, and the recessed bottom locating holes 51 are slightly expansible. When put the flat accessories boxes 12;22;32 in the trays 10;20;30, the respective locating blocks 50 are respectively press-fitted into the respective recessed bottom locating holes 51, thereby causing the flat accessories boxes 12;22;32 to be respectively firmly secured to the trays 10;20;30. The friction force between the respective flat accessories boxes 12;22;32 and the respective trays 10;20;30 is sufficient to firmly secure the into the respective recessed bottom locating holes 51, thereby causing the flat accessories boxes 12;22;32 to the trays 10;20;30, and the flat accessories boxes 12;22;32 do not fall from the trays 10;20;30 when turning the trays 10;20;30 about the pivot shaft 40.

Figure 2:
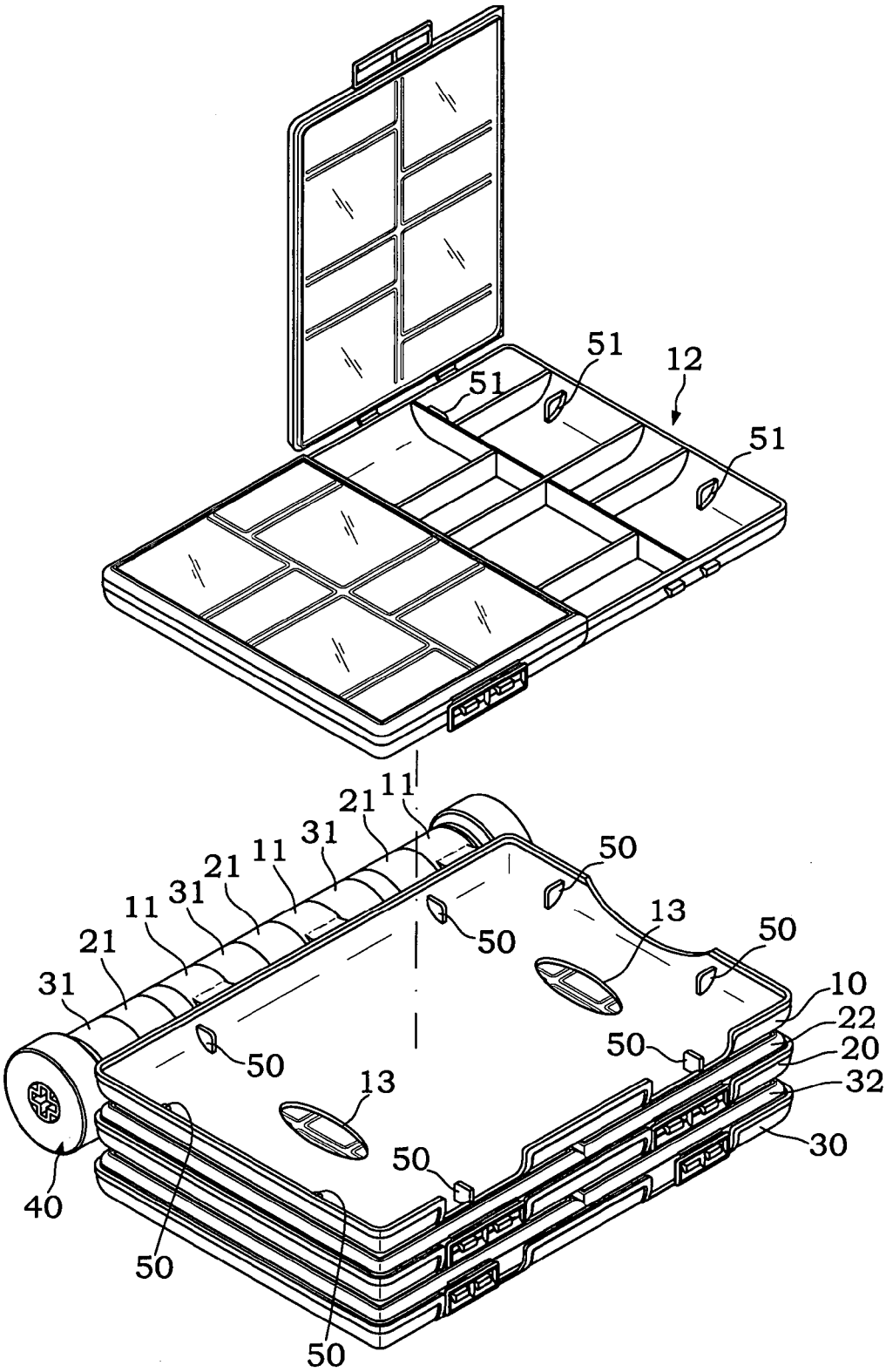
FIG. 2 is an exploded view of the storage rack according to the present invention.
Figure 4:
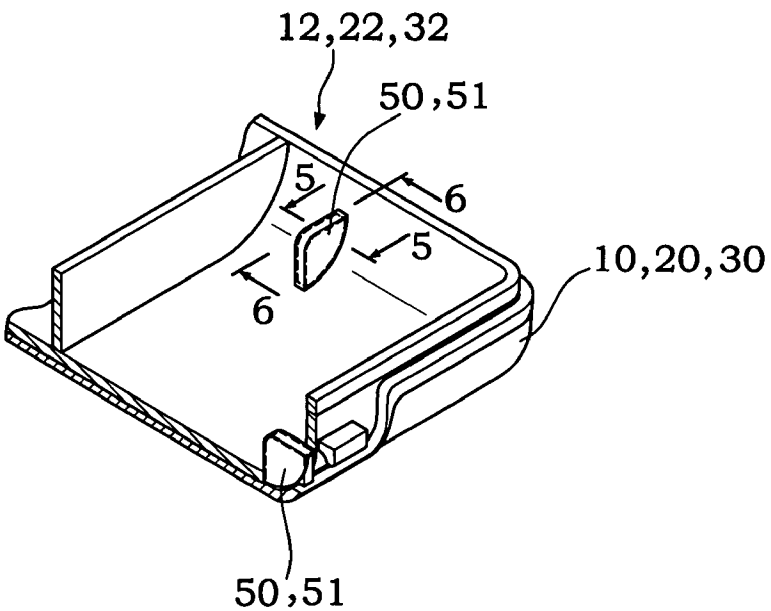
FIG. 4 is an assembly view of FIG. 3.
Figure 3:
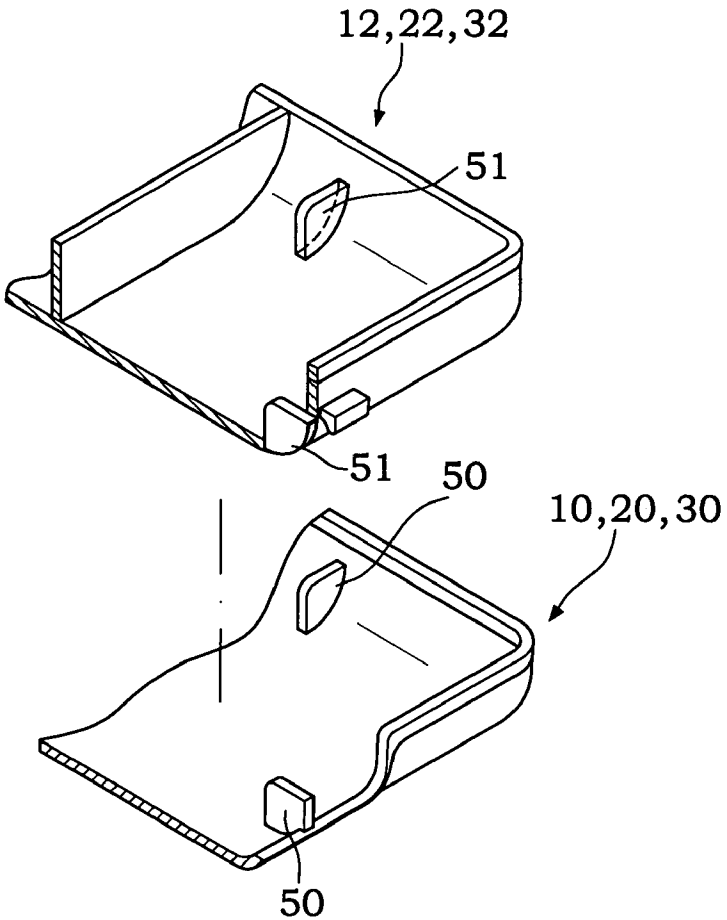
FIG. 3 is an exploded view in an enlarged scale of a part of the present invention.
Figure 6:
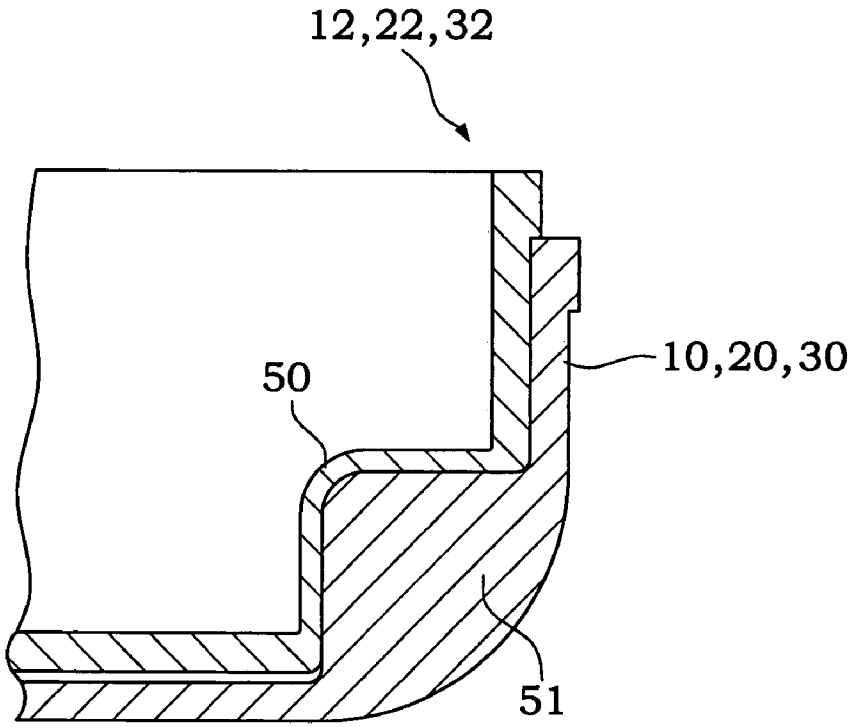
FIG. 6 is a sectional view taken along line 6-6 of FIG. 4.
Figure 5:
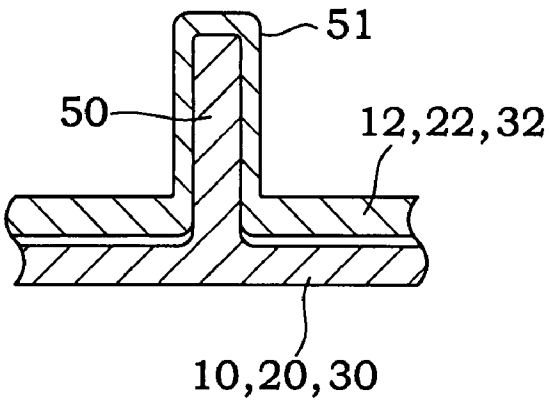
FIG. 5 is a sectional view taken along line 5-5 of FIG. 4.
Figure 7:
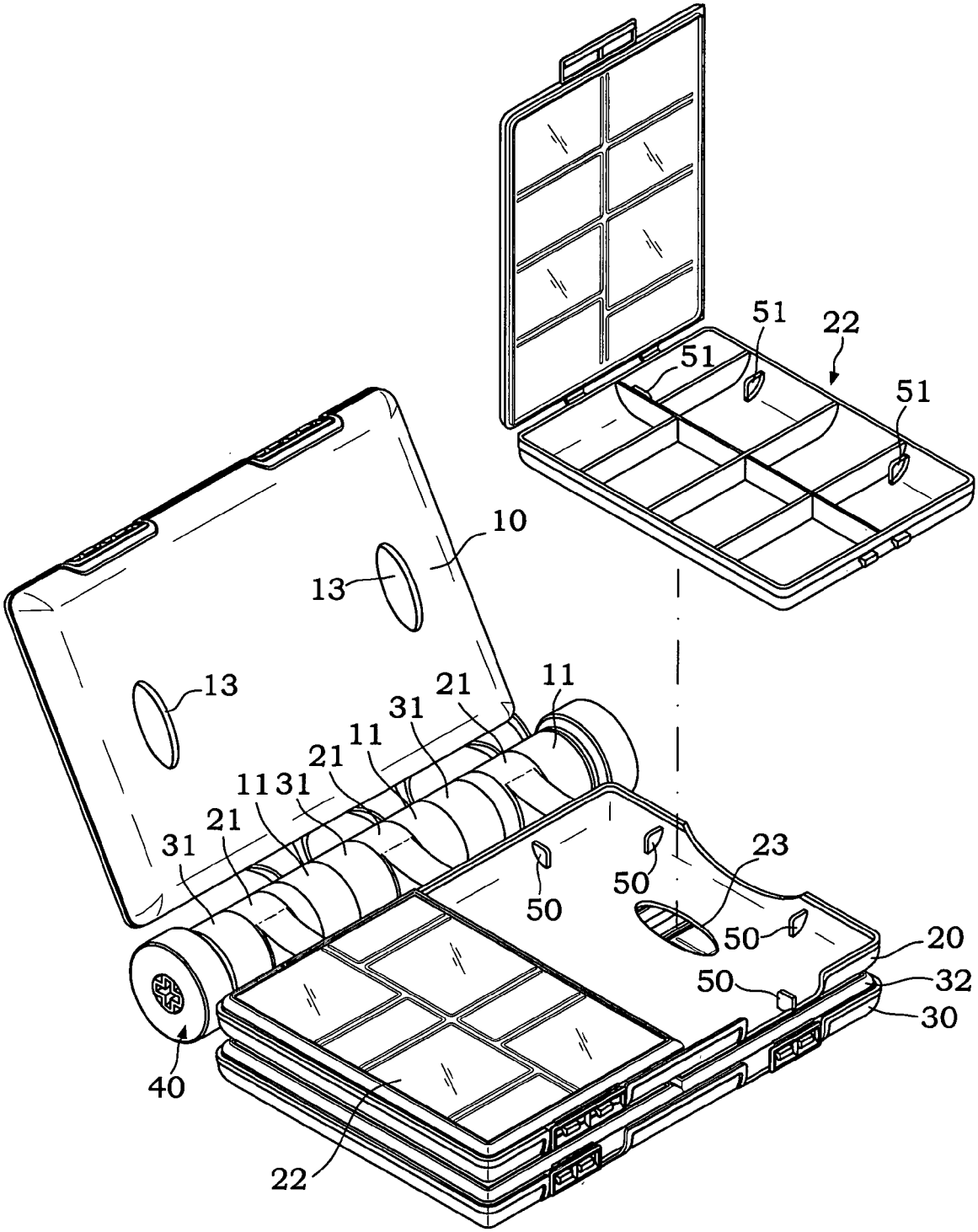
FIG. 7 is another exploded view of the storage rack according to the present invention.
Figure 8:
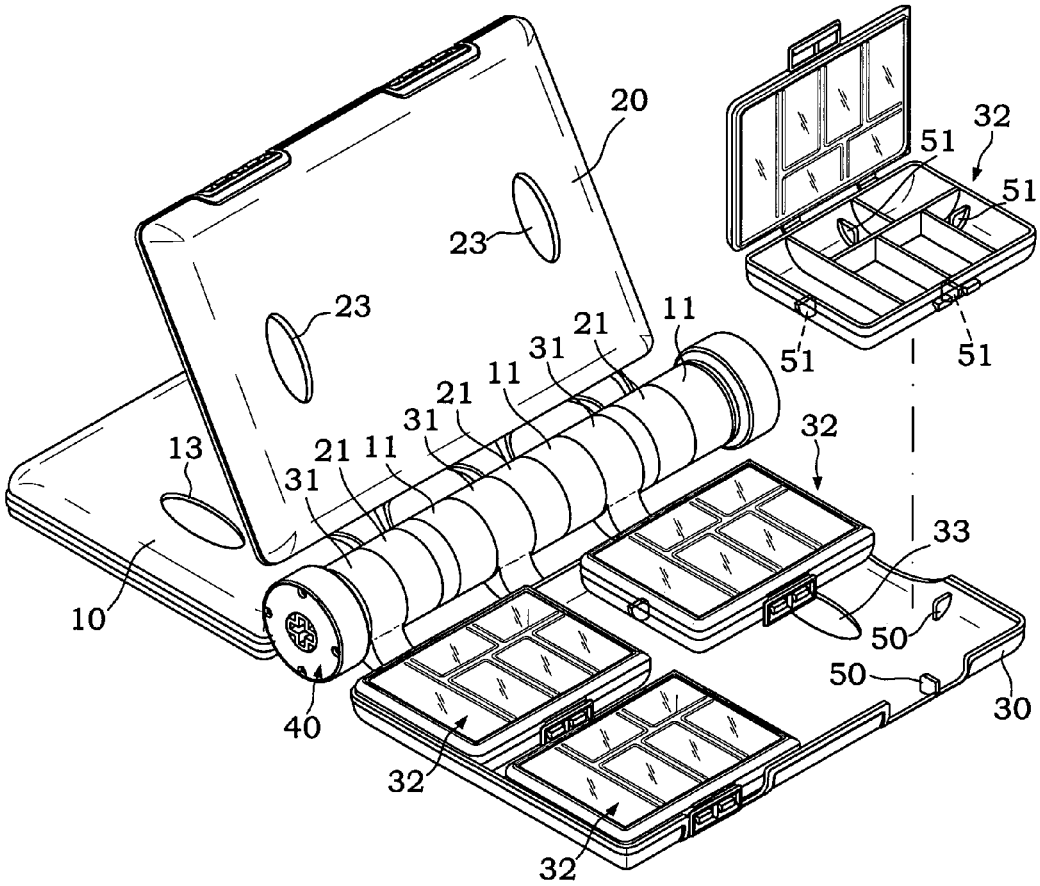
FIG. 8 is still another exploded view of the storage rack according to the present invention.

Referring to FIGS. 2, 7, and 8, each tray 10;20;30 has two oval through holes 13;23;33 symmetrically disposed near two opposite lateral sides. The user can insert a finger through the oval through holes 13;23;33 to push the flat accessories boxes 12;22;32 upwardly away from the trays 10;20;30 in direction reversed to the bonding direction between the locating blocks 50 and the recessed bottom locating holes 51. Therefore, the recessed bottom locating holes 51 can be smoothly disengaged from the locating blocks 50 without damaging the locating blocks 50.

Referring to FIG. 7, the tray 20 carrying two medium-size flat accessories boxes 22 is seen after opening of the tray 10 carrying one big-size flat accessories box 12 from the other trays. The medium-size flat accessories boxes 22 are about one half of the size of one big-size flat accessories box 12. Every medium-size flat accessories box 22 has a plurality of bottom locating holes 51 disposed adjacent to three of the four sides thereof and connected to corresponding locating blocks 50 at the tray 20.

Referring to FIG. 8, the tray 30 carrying four small-size flat accessories boxes 32 is seen after opening of the tray 10 carrying one big-size flat accessories box 12 with the tray 20 carrying two medium-size flat accessories boxes 22. The small-size flat accessories boxes 32 are about one half of the size of one medium-size flat accessories box 22. Every small-size flat accessories box 32 has a plurality of recessed bottom locating holes 51 disposed adjacent to two of the four sides thereof and connected to corresponding locating blocks 50 at the tray 30.

Figure 9:
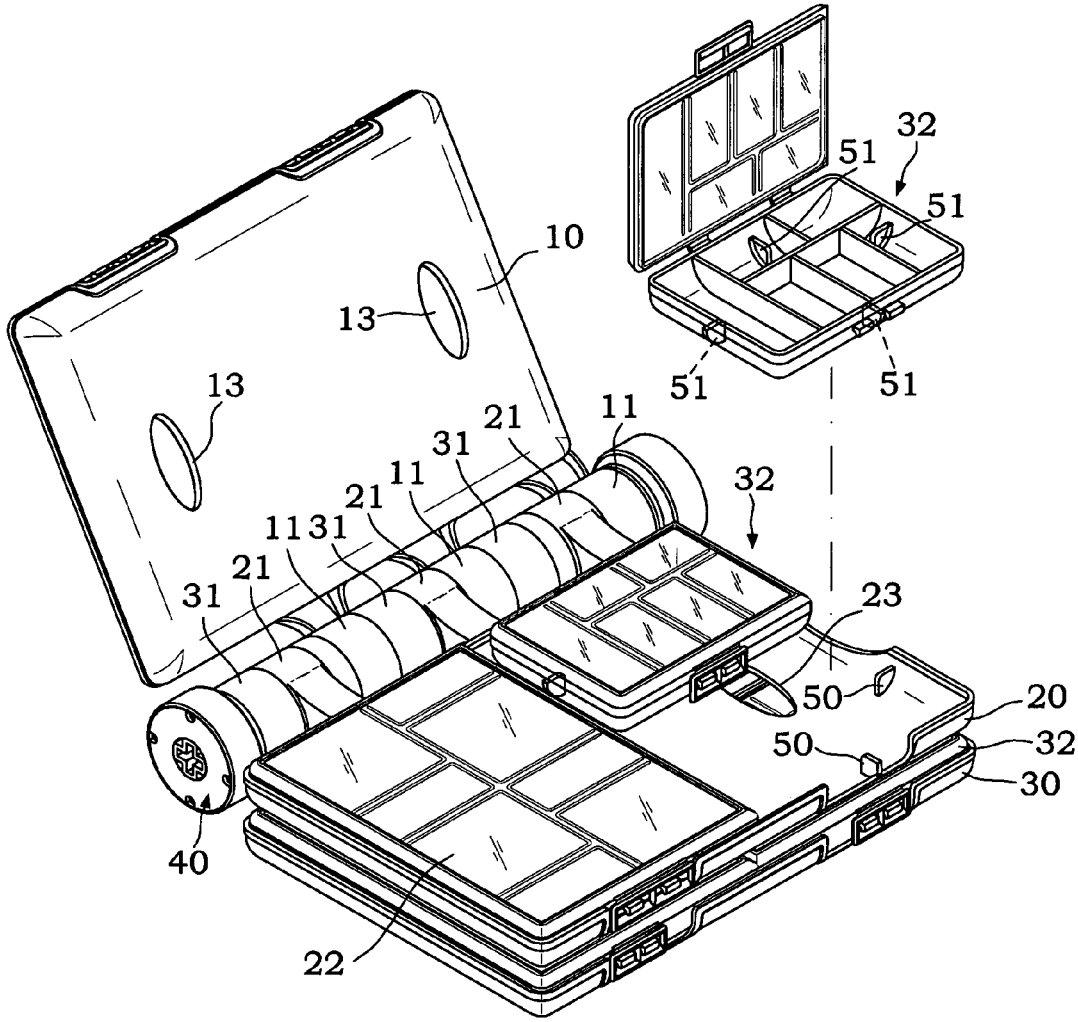
FIG. 9 is still another exploded view of the storage rack according to the present invention.

Referring to FIG. 9, one medium-size flat accessories box 22 and two small-size flat accessories boxes 32 can be carried in one tray 20. By means of the recessed bottom locating holes 51 at the flat accessories boxes 12;22;32 and the locating blocks 50 at the trays 10;20;30, the flat accessories boxes 12;22;32 can detachably and selectively set in the trays 10;20;30.

A prototype of storage rack has been constructed with the features of the annexed drawings of FIGS. 1~9. The storage rack functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A storage rack comprising a pivot shaft, a plurality of trays molded from plastics and respectively pivoted to said pivot shaft, a plurality of flat accessories boxes molded from plastics and respectively detachably carried in said trays, and a positioning structure adapted to secure said flat accessories boxes to said trays, wherein said positioning structure comprises a plurality of recessed locating holes disposed at a bottom side of each of said flat accessories boxes, and a plurality of locating blocks provided at a top side of each of said trays and adapted to engage said recessed locating holes, and wherein said trays each have at least one through hole therein for the insertion of user's finger to push said flat accessories boxes away from said trays.

2. The storage rack as claimed in claim 1, wherein said trays each have a plurality of through holes symmetrically disposed near two opposite lateral sides thereof for the insertion of the user's finger to push said flat accessories boxes away from said trays.

3. The storage rack as claimed in claim 1, wherein the number of the recessed locating holes at each said flat accessories box is equal to the number of the locating blocks at each said tray.

4. A storage rack comprising a pivot shaft, a plurality of trays molded from plastics and respectively pivoted to said pivot shaft, a plurality of flat accessories boxes molded from plastics and respectively detachably carried in said trays, and a positioning structure adapted to secure said flat accessories boxes to said trays, wherein said positioning structure comprises a plurality of recessed locating holes disposed at a bottom side of each of said flat accessories boxes, and a plurality of locating blocks provided at a top side of each of said trays and adapted to engage said recessed locating holes, wherein said recessed locating holes are respectively arranged along three of four sides of each said flat accessories box and coupled to corresponding locating blocks at said trays.

5. A storage rack comprising a pivot shaft, a plurality of trays molded from plastics and respectively pivoted to said pivot shaft, a plurality of flat accessories boxes molded from plastics and respectively detachably carried in said trays, and a positioning structure adapted to secure said flat accessories boxes to said trays, wherein said positioning structure comprises a plurality of recessed locating holes disposed at a bottom side of each of said flat accessories boxes, and a plurality of locating blocks provided at a top side of each of said trays and adapted to engage said recessed locating holes, wherein said recessed locating holes are respectively arranged along two adjacent sides of each said flat accessories box and coupled to corresponding locating blocks at said trays.

* * * * *